US007686186B2

(12) United States Patent
Smith

(10) Patent No.: US 7,686,186 B2
(45) Date of Patent: Mar. 30, 2010

(54) GOLF BALL CONTAINER

(75) Inventor: Jason Smith, Snellville, GA (US)

(73) Assignee: New Possibilities, Inc., Lawrenceville, GA (US)

( * ) Notice: Subject to any disclaimer, the term of this patent is extended or adjusted under 35 U.S.C. 154(b) by 654 days.

(21) Appl. No.: 11/516,453

(22) Filed: Sep. 6, 2006

(65) Prior Publication Data

US 2007/0241129 A1 Oct. 18, 2007

Related U.S. Application Data

(63) Continuation-in-part of application No. 11/404,722, filed on Apr. 14, 2006.

(51) Int. Cl.
*A47F 1/04* (2006.01)

(52) U.S. Cl. ..... 221/309; 221/310

(58) Field of Classification Search ..... 221/309, 221/310

See application file for complete search history.

(56) References Cited

U.S. PATENT DOCUMENTS

| | | | | |
|---|---|---|---|---|
| 1,810,491 | A | | 6/1931 | McClure |
| 2,768,775 | A | | 10/1956 | Houser |
| 3,206,067 | A | | 9/1965 | Smith et al. |
| 4,106,678 | A | * | 8/1978 | Thomas ..... 221/309 |
| 4,299,345 | A | | 11/1981 | Lanzl |
| 4,678,108 | A | | 7/1987 | Inman |
| 4,850,483 | A | | 7/1989 | Stack |
| 4,875,579 | A | | 10/1989 | Tak |
| 5,060,996 | A | | 10/1991 | Garnes |
| 5,147,101 | A | | 9/1992 | Tiller |
| 5,361,958 | A | | 11/1994 | Fiegel et al. |
| D366,143 | S | | 1/1996 | Guzman |
| 5,775,751 | A | | 7/1998 | Nelson |
| 5,934,530 | A | | 8/1999 | Antczak et al. |
| 5,988,433 | A | * | 11/1999 | Crum ..... 221/309 |
| 6,273,833 | B1 | | 8/2001 | Murphy |
| 6,419,600 | B1 | | 7/2002 | York et al. |
| 6,481,595 | B1 | | 11/2002 | Chilton |
| 2004/0084495 | A1 | | 5/2004 | Rudeen et al. |

OTHER PUBLICATIONS

U.S. Appl. No. 11/404,722, filed April 14, 2006.

* cited by examiner

*Primary Examiner*—Gene Crawford
*Assistant Examiner*—Timothy R Waggoner
(74) *Attorney, Agent, or Firm*—Baker Donelson

(57) ABSTRACT

A container that holds the golf balls for sequential dispensing of golf balls from an interior cavity through an opening between a pair of opposing legs and a projecting stop movable from a first position for holding one of the golf balls between the legs and retained by the projecting stops to a second outward position sufficient for the golf ball to pass by the projecting stops. A method of holding and sequentially dispensing golf balls for play is disclosed.

44 Claims, 6 Drawing Sheets

GOLF BALL CONTAINER

The present application is a continuation-in-part of co-pending U.S. patent application Ser. No. 11/404,722, filed Apr. 14, 2006.

TECHNICAL FIELD

The present invention relates to containers for golf balls. More particularly, the present invention relates to sleeve containers for carrying golf balls while facilitating selective removal of one of the golf balls from the container for play.

BACKGROUND OF THE INVENTION

The sport of golf is an entertaining activity involving athletic skill and mental concentration to play a round in as few strokes as possible. There are a number of different types of clubs used in playing golf. These clubs are carried in an elongate open-ended bag. The bag is carried by a shoulder strap. Typically, golf bags include a number of pockets which are closed with zippers, buttons, or snaps. The pockets are used for carrying supplies such as golf balls, golf tees, towels, gloves, score cards, and other accouterments particular for golfing.

To be successful in golf, a golfer must drive the ball within the fairways and the approaches to the greens, while avoiding hazards on the course. Hazards include the rough or tall brush areas, sand traps, water hazards, and other grounds areas that are out of bounds or leave the golfer with a difficult shot. While driving the ball within the fairways is the preferable goal leading to success, golfers often have problems with losing golf balls. For example, drives may the golf ball to hook or slice and send the ball into fairway hazards. The rough particularly poses problems, as the rough includes areas along the sides of the fairways, and a driven ball that hooks or slices may easily carry into the rough. Rough can vary from grass standing slightly taller than the grass in the fairway to tall grass, brush, bushes, and trees. Although golfers assist each other by observing the flight of the ball, balls driven into rough frequently are lost. Generally, if a short search does not locate the ball, the golfer selects and plays a new ball, with a stroke penalty. Similarly, a ball driven into a water hazard typically is not playable, unless closely near a shallow edge of the water hazard. Generally, a ball driven into rough or into a water hazard necessitates having to replace a lost ball to resume play.

While bags have pockets for holding golf balls, selecting a particular ball from a group of balls in a pocket is cumbersome and time consuming. For example, golfers often include in the pockets a number of older balls for practice together with new or better ones of the golf balls for use in play. Selecting a new ball for replacement involves searching through the balls in the pockets of the golf bag or locating the particular pocket with new balls prepositioned for play. In addition to time spent searching for a ball lost in the rough, selecting a new ball from a collection of balls may further delay the play of the round. Some courses have strict time limits on the amount of time one can spend searching for a ball, in order to avoid inconveniencing other players on the course.

Accordingly, there is a need in the art for an improved carrier for holding golf balls for selective access for play when necessary. It is to such that the present invention is directed.

SUMMARY

The present invention meets the need in the art by providing a container for sequential dispensing of golf balls, comprising a housing having an interior cavity for receiving at least one golf ball and a pair of opposing legs extending from the housing and defining an opening. A projecting stop extends inwardly from at least one of the legs for holding the golf ball between the legs. The projecting stop is selectively movable from a first position for holding the golf ball between the legs and a second position outwardly for releasing the golf ball for passage through the opening between the legs. The projecting stop being moved from the first position to the second position enables the golf ball to pass by the projecting stop and through the opening for removal from the container. A cap defining an aperture pivotably attaches to an upper edge of the container to be movable from a first position coextensive with the upper edge and a second position lateral of the container, for selective receiving a shaft of a golf club therethrough.

In another aspect, the present invention provides a container for sequential dispensing of golf balls, comprising an elongated housing having an interior cylindrical cavity for receiving a plurality of golf balls and having a first diameter. A pair of opposing legs extend co-axial with the cavity and define an opening at an end of the cavity, the legs having opposing edges to define opposing gaps for grasping a surface of a golf ball held between the legs. A projecting stop extends inwardly of the cavity for restricting passage of a golf ball from the opening, the projecting stop having a first position for holding the golf ball between the legs and a second position for passage of the golf ball through the opening. The projecting stop comprises a distal end of a threaded member extending through the leg inwardly and secured to the leg and projecting from an interior surface of one of the legs towards the opposing leg. The projecting stop being moved from the first position to the second position enables the golf ball to pass by the projecting stop and through the opening for removal from the container.

Objects, advantages, and features of the present invention will become readily apparent upon reading the following detailed description in conjunction with the drawings and the appended claims.

DETAILED DESCRIPTION

Figure 1:
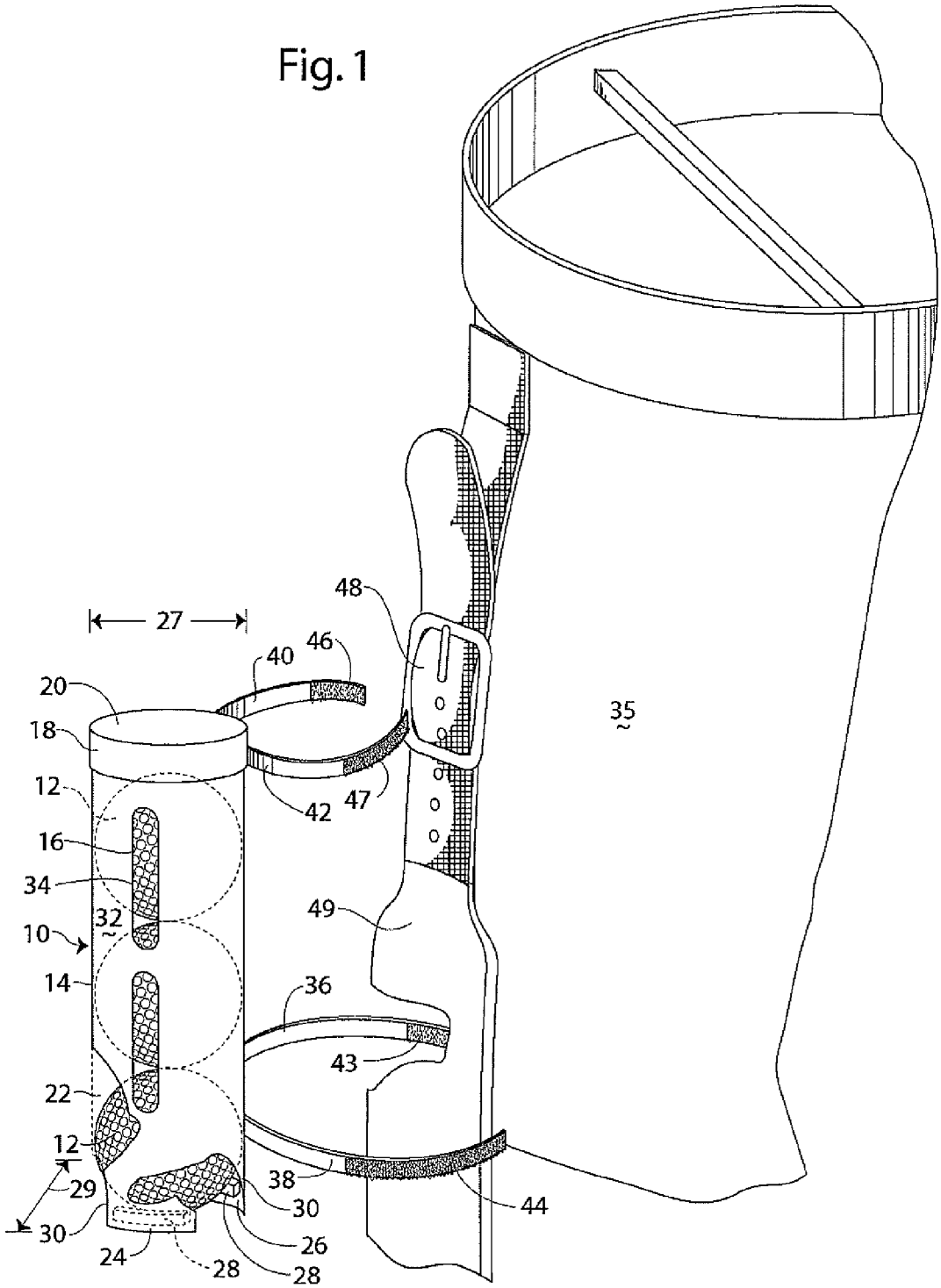
FIG. 1 illustrates in perspective partially cut-away view a carrier for golf balls according to the present invention.

With reference to the drawings, in which like parts have like reference numerals, FIG. 1 illustrates in perspective partially cut-away view a sleeve or container 10 according to the present invention for holding a plurality of golf balls 12 for sequential removal for play. The container 10 includes a housing 14 that defines an interior cavity 16 for holding the golf balls 12. The housing 14 has a first end 18 and on opposing second end 22. In the illustrated embodiment, the first end 18 is open to the interior 16 and closed by a cap 20. The opposing second end 22 is also open to the interior cavity 16. A pair of opposing legs 24 extend from the housing about the opening in the second end 22. Each of the legs 24 has an interior surface 26 that includes a projecting stop 28. The stop 28 extends towards the opposing stop.

The interior cavity 16 holds the golf balls 12. In the illustrated embodiment, the cavity 16 is cylindrical as defined by a curved wall of the housing 14. The cavity 16 has a diameter 27 closely approximating that of a golf ball, so that a plurality of golf balls 12 stack sequentially in the housing 14.

The opposing stops 28 define a gap having a distance 29 smaller than the diameter of the interior cavity. The stops 28 hold one of the golf balls between the legs 24. The projecting stops 28 can be integral with the legs 24 or resilient members that attach to the legs, such as with a fastener or adhesive. The members used for the stops 28 are made of a resilient material such as rubber or plastic.

In the illustrated embodiment, the legs 24 also define opposing notches 30 for gripping an exposed surface portion of the golf ball between the legs 24.

A side wall 32 of the housing 14 includes an elongate slot 34. The slot 34 provides a window into the cavity 16 to observe the number of golf balls 12 held within the housing 14.

The container 10 includes attaching devices for securing the container to a golf bag 35. The embodiment illustrated in FIG. 1 includes a first and second strap 36, 38 that engage together and a third and fourth strap 40, 42 that engage together. The pairs of straps 36, 38 and 40, 42 are spaced apart. The straps 36, 38 are elongated band members that attach to the container 10 intermediate the first end 18 and the second end 22. The straps 36, 38 are configured for mating engagement to the opposing strap. In the illustrated embodiment, an outer surface of the strap 36 has a surface 43 of a first character while the strap 38 has a surface 44 of a second character that matingly engages the surface 43 of the first character, for example hook and loop fasteners. In an alternate embodiment (not illustrated), the straps 36, 38 engage by engageable buckles or other conventional matingly engageable clips.

The second pair of straps 40, 42 likewise have surfaces 46, 47 of the first character and second character that matingly engage. In an alternate embodiment (not illustrated) the straps 40, 42 connect with buckles, clips or other conventional strap connectors.

As shown in the illustrated embodiment, the second pair of straps 40, 42 engage a buckle 48 of the strap golf bag while the first pair of straps 36, 38 wrap around a portion of the strap 49 longitudinally spaced from the buckle 48. Attaching the container 10 with the second pair of straps 40, 42 to the buckle 48 keeps the container from sliding longitudinally relative to the golf bag strap 49 while the first set of straps 36, 38 keep the container from pivoting or swinging around as the golf bag is carried during play of the golf match.

Figure 2:
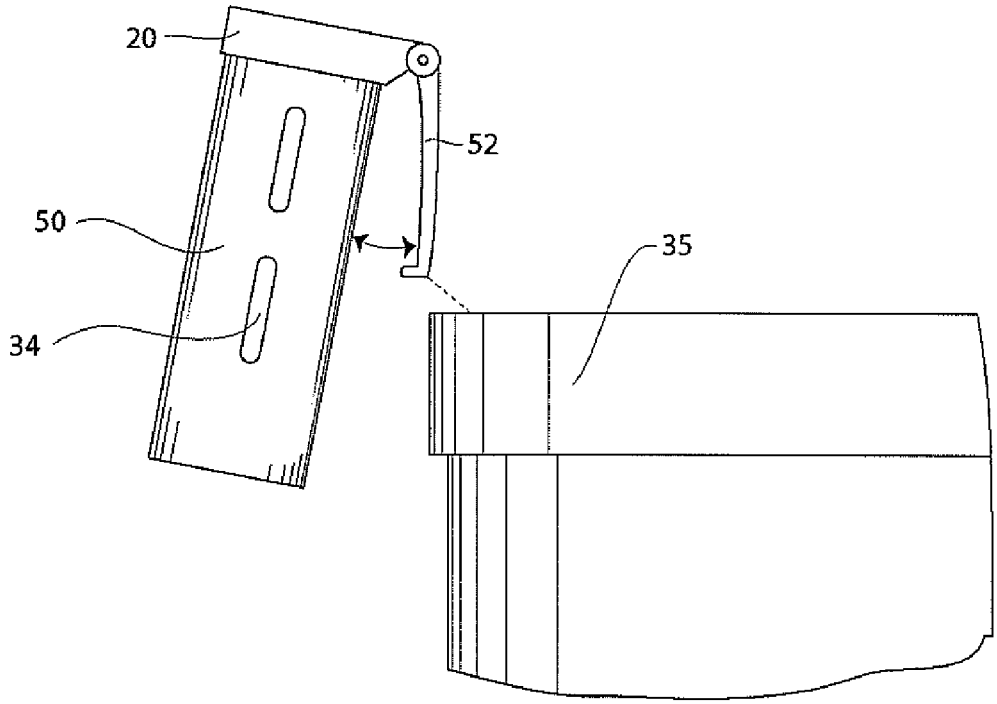
FIG. 2 illustrates in side view a second embodiment of the carrier for golf balls.

FIG. 2 is a side view of an alternate embodiment of the container 50 according to the present invention. In this embodiment, the cap 20 includes a spring-biased arm 52 pivotally attached to a side of the cap 20. The arm 52 extends longitudinally for being received within an opening of the golf bag 35. The arm 52 moves from a first position biased towards the container 10 and a second position pivoted away from the container 10. With the arm 52 in the second position, the container 10 attaches to the golf bag by inserting the arm into the opening of the golf bag. Upon release, the arm 52 pivots to the first position for bearing against the inner wall of the golf bag 35. The spring biases the arm 52 inwardly towards the container 10 to secure the container in place on the golf bag.

Figure 3:
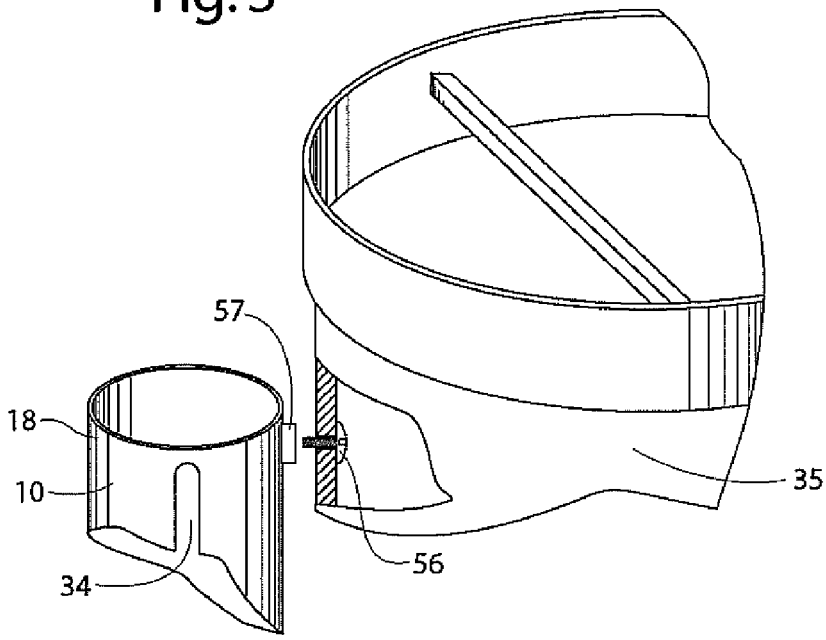
FIG. 3 illustrated in detailed perspective partially cut-away view a third embodiment of the carrier for golf balls.

FIG. 3 illustrates in perspective cut-away view a third embodiment of the container 10. A fastener 56 extends through an opening in the side wall of the golf bag 35 and engages the container 10. In the illustrated embodiment, the fastener 56 engages a nut 57 or similar member for securing the container to the golf bag 35.

Figure 4:
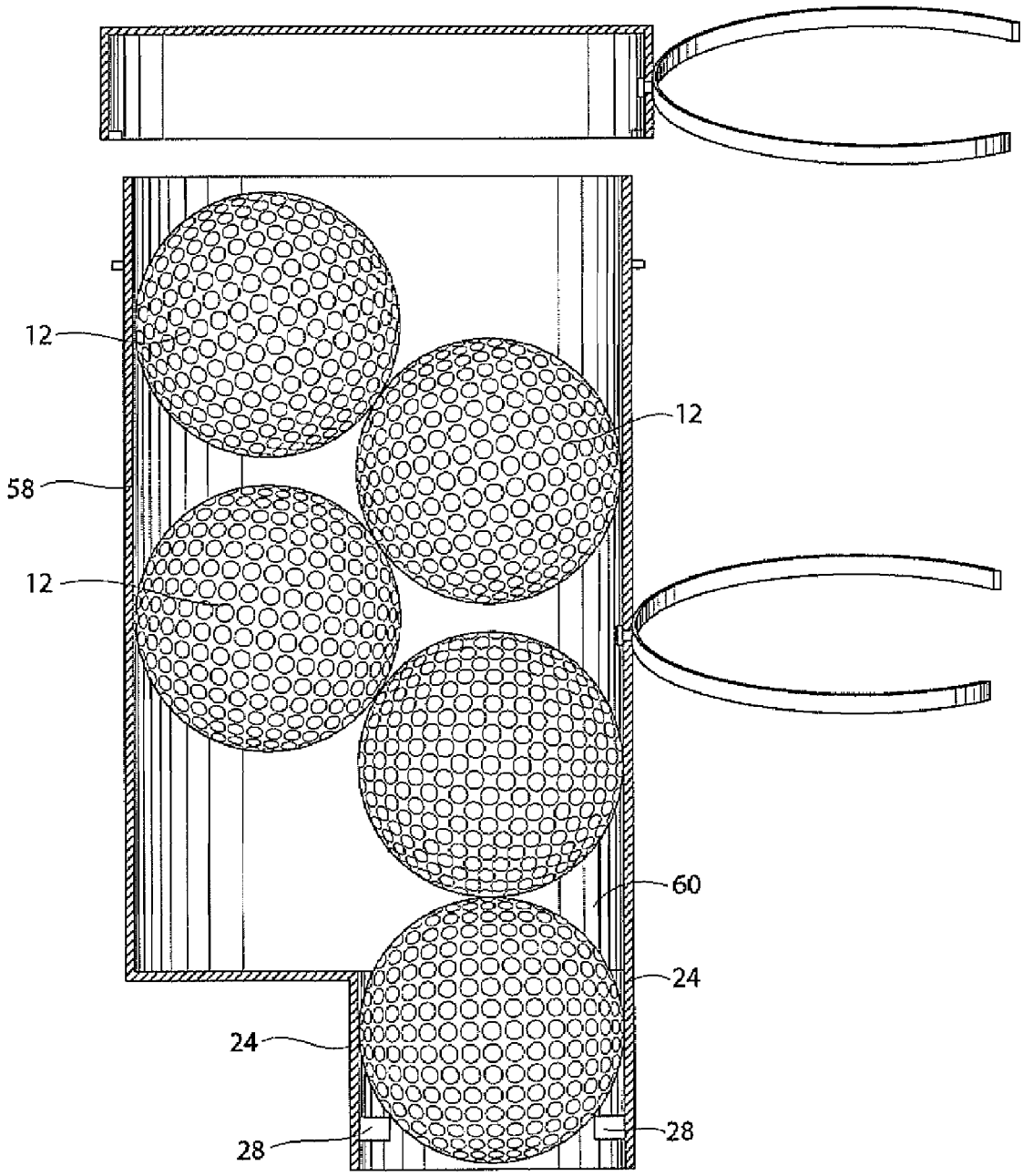
FIG. 4 illustrates in cross-sectional side view a fourth embodiment of the carrier for golf balls in accordance with the present invention.

FIG. 4 illustrates in cross-sectional side view an alternate embodiment of the present invention. In this embodiment, the housing 58 has an interior cavity sized for receiving golf balls 12 in staggered or side-by-side relation. An opening 60 permits the golf balls 12 to be removed sequentially through an opening between the legs 24. The interior projecting stops 28 hold the golf ball between the legs.

Figure 5:
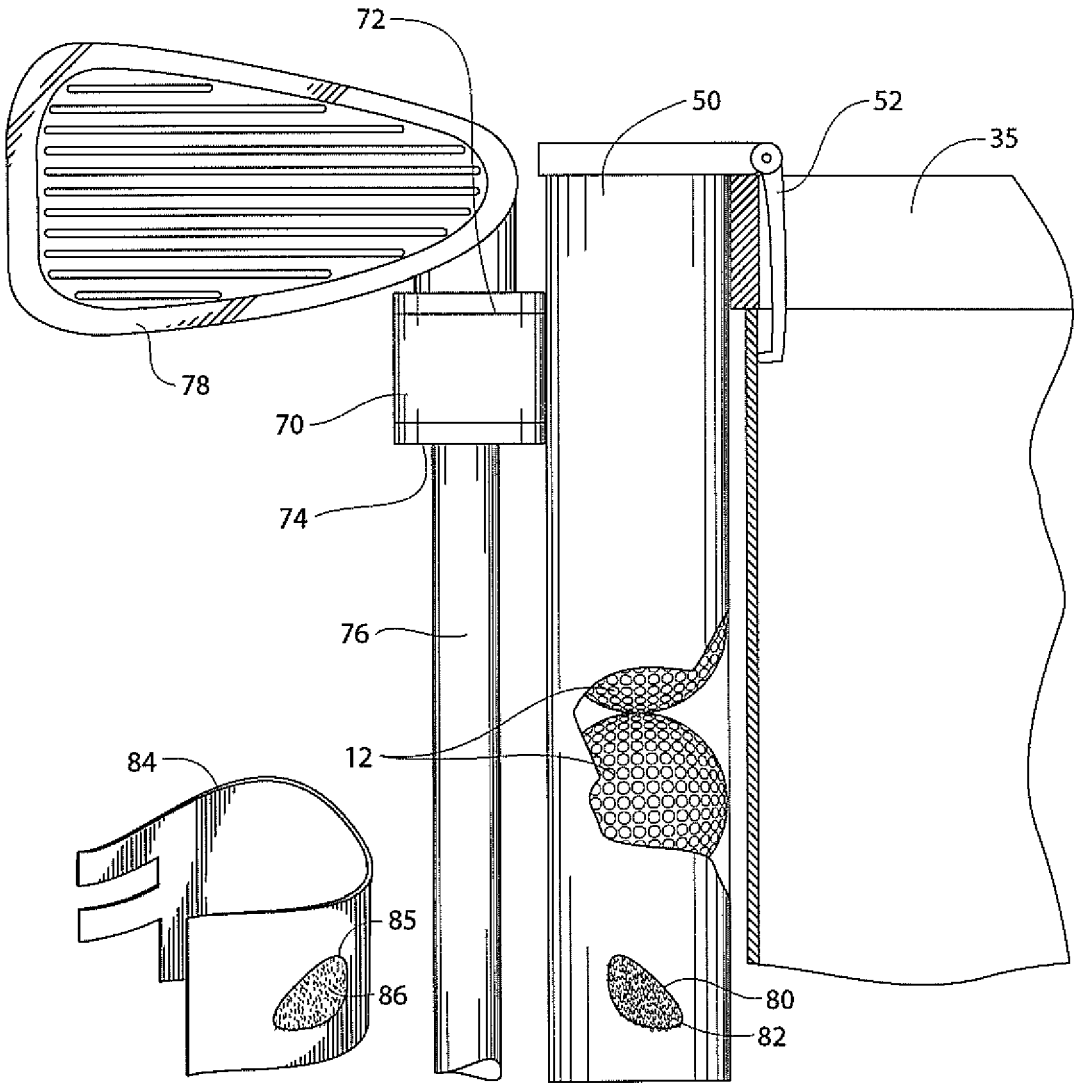
FIG. 5 illustrates in side view an alternate embodiment of the carrier for golf balls in accordance with the present invention.

FIG. 5 illustrates in side partially cut-away view an alternate embodiment of the present invention. The container 50 is illustrated using the spring-biased arm 52 for attaching the container 50 to the golf bag 35, but other of the attaching devices may be used. In this embodiment, the container 50 includes a laterally projecting open-ended holder 70. The holder 70 may be cylindrical, rectangular, or other configuration having open opposing ends 72, 74 and a through bore. The holder 70 attaches to the container 50 with adhesive, screws, or other fastening devices, or may be integral with the container. The holder 70 receives through the open ends 72, 74 a shaft 76 of a putter 78. A patch 80 having a surface 82 of a first character attaches to an exterior wall of the container 50. The patch 80 in the illustrated embodiment attaches adhesively. A golf accessory 84, such as a glove (illustrated in partial view), towel, or other accessory, includes a mating patch 85 having a surface 86 of a second character. The patch 85 having the second character 86 matingly engages the patch 80 having the first character 82. Thus the accessory 84, such as a glove or towel, is readily accessible for use with the container 50 attached to the golf bag 35.

One embodiment of the carrier 10 illustrated in FIG. 1 is configured for holding six golf balls in a cylindrical tube having a 1.875 inch inner diameter and a ⅛ inch wall thickness, and a length of 10.5 inches. The legs 24 are 1 inch long and the apex of the opening defined between the opposing legs can be rounded or peaked.

The container 10 of the present invention sequentially meters golf balls 12 held in the cavity 16. The golf balls 12 are held in the cavity 16 with one golf ball held between the legs 24 by the stops 28. To remove a golf ball 12 from the cavity 16, the opposing exposed surface portions of the golf ball are gripped. The notches 30 facilitate gripping access to golf ball. A pulling force exerted on the golf ball 12 moves the legs 24. The legs 24 move from the first position with the stop members 28 holding the golf ball 12 to the second position with the legs flexed outwardly. In this second position, the golf ball 12 is readily moved past the projecting stops 28 and thereby removed from the container 10. Upon removal of the golf ball 12, the legs 24 flex inwardly to the first position. The stops 28 contact and hold the next golf ball in the container 10.

The container 10 attaches to the golf bag for holding and sequentially dispensing the golf balls 12 for use. With respect to FIG. 1, this is accomplished by threading the opposing straps 40, 42 through the buckle 48 of the strap 49 for the golf bag. This positions the container 10 at an upper portion of the golf bag. The first set of straps 36, 38 extend around a portion of the strap 49. The straps 36, 38 prevent the container 10 from pivoting and swinging back and forth as the golf bag is carried during a round of golf. The second set of straps 40, 42 hold the container 10 at the upper portion of the golf bag. This prevents the container 10 from moving longitudinally along the strap of the golf bag.

In the embodiment illustrated in FIG. 2, the arm 52 pivots to the second position and extends into the open end of the golf bag. Upon release, the arm pivots towards the container 10 and bears upon an inner wall of the bag to hold the container to the golf bag.

In the embodiment illustrated in FIG. 3, the fastener 56 extending through the sidewall of the golf bag engages the container 10, and secures the container to the golf bag.

The embodiment in FIG. 4 holds balls in staggered side-by-side relation for dispensing through, the opening between the legs 24. This embodiment is similarly attached to the golf bag by mechanisms discussed above with reference to FIGS. 1-3. The container operates as described above by pulling the golf ball from between the legs 24.

It is to be appreciated that the container 10 has an opening closed by the cap 20. The cap can be threaded, clipped, or friction fit upon the open end of the housing. Upon removal of the cap, the container 10 is filled with golf balls. In an alternate embodiment, the container 10 is closed at the first end 18. Golf balls 12 insert into the cavity 16 through the opening between the legs 24.

The container 50 illustrated in FIG. 5 readily carries the putter 78 conveniently accessible for use by passing the shaft 76 through the open ends 72, 74 of the holder 70. Similarly, the accessory 84 is readily available for use by matingly connecting the patches 80, 85 by engaging the opposing mating surfaces 82, 86, for example using VELCRO brand hook and latch fabric connectors. Other similar connector devices may be used for detachably engaging the accessory 84 to the container 50, such as clips, pins, buttons, and other detachably engaging connectors.

Figure 6A:
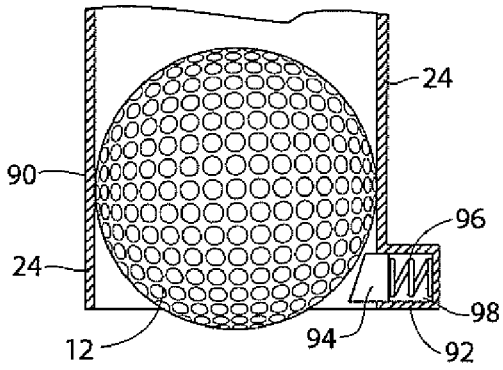
FIG. 6A illustrates in cross-sectional side elevational view a lower portion of an alternate embodiment of a golf ball container and projecting stop according to the present invention.

FIG. 6A illustrates in cross-sectional side elevational view a lower portion of an alternate embodiment of a golf ball container 90 that includes a projecting stop 92 in one of the legs 24. The projecting stop 92 includes a movable wedge 94 biased to a first position inwardly of the container by a spring 96 bearing against a housing 98. The projecting stop 92 bears against the golf ball 12 to hold it in position in the opening of the container for selective removal for use.

Figure 6B:
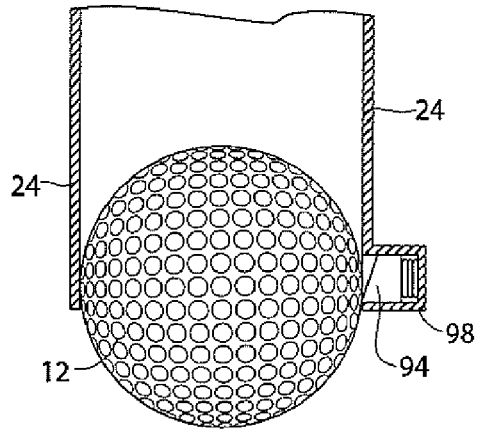
FIG. 6B illustrates the alternate embodiment shown in FIG. 6A in a second position for removing the golf ball from between the legs of the container.

FIG. 6B illustrates the golf ball container 90 in a second position for removing the golf ball 12 from between the legs 24 of the container. The wedge 94 moves to a second position outwardly relative to the container to provide clearance for passage of the golf ball 12 through the opening defined by the legs 24. This is accomplished by the golfer grasping the golf ball 12 on the surfaces exposed in the opposing gaps between the opposing edges of the legs 24, and pulling downwardly. The pulling force causes the golf ball 12 to bear against the biased wedge 94 and move the wedge 94 against the spring 96 laterally outwardly in the housing 98.

Figure 7A:
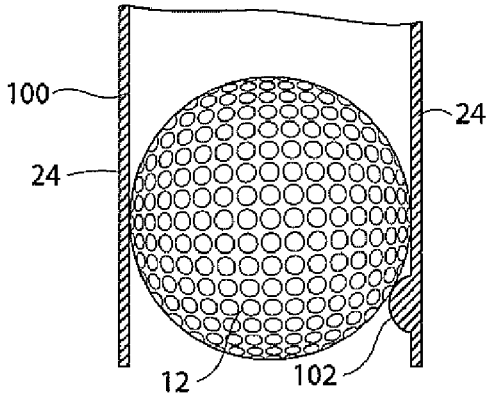
FIG. 7A illustrates in cross-sectional side elevational view a lower portion of an alternate embodiment of a golf ball container and projecting stop according to the present invention.

FIG. 7A illustrates in cross-sectional side elevational view a lower portion of an alternate embodiment of a golf ball container 100 with a projecting stop 102 formed integrally with the leg 24 of the container. The projecting stop in a first position extends inwardly of the cavity in the container sufficiently to hold the golf ball from passing readily through the opening at the lower end of the container until the golf ball is needed for use.

Figure 7B:
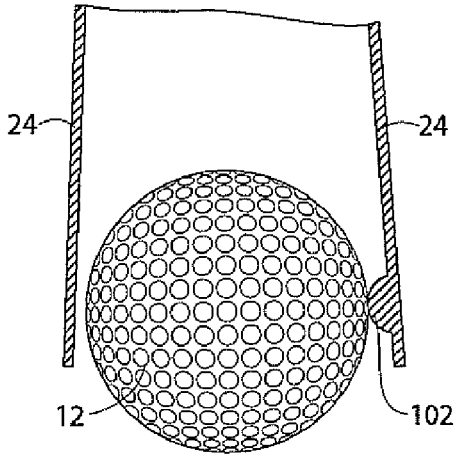
FIG. 7B illustrates the alternate embodiment shown in FIG. 7A in a second position for removing the golf ball from between the legs of the container.

FIG. 7B illustrates the container 100 shown in FIG. 7A with the projecting stop 102 in a second position for removing the golf ball 12 from between the legs 24 of the container. The legs 12 flexibly move outwardly as illustrated upon downwardly pulling on the golf ball 12 to remove the golf ball for use.

Figure 8:
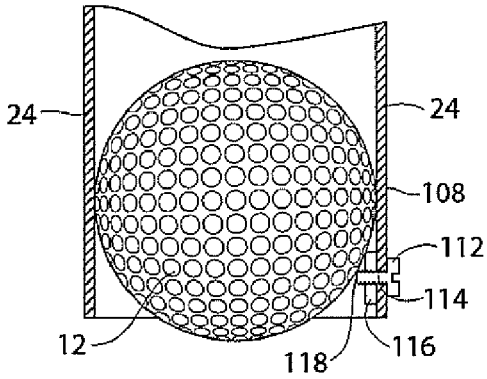
FIG. 8 illustrates in cross-sectional side elevational view a lower portion of an alternate embodiment of a golf ball container and projecting stop according to the present invention.

FIG. 8 illustrates in cross-sectional side elevational view a lower portion of an alternate embodiment of a golf ball container 108 with a projecting stop 110 made of a threaded fastener 112 extending through an opening 114 in the leg 24. The fastener 112 is secured to the leg 24 with a nut 116 or threaded bore in the leg 24. A distal edge 118 of the fastener 112 bears against the golf ball 12 until needed. The golf ball 12 is removed by flexibly moving the legs 24 outwardly relative to each other to enable the golf ball to pass the projecting stop and pass through the opening between the legs.

Figure 9:
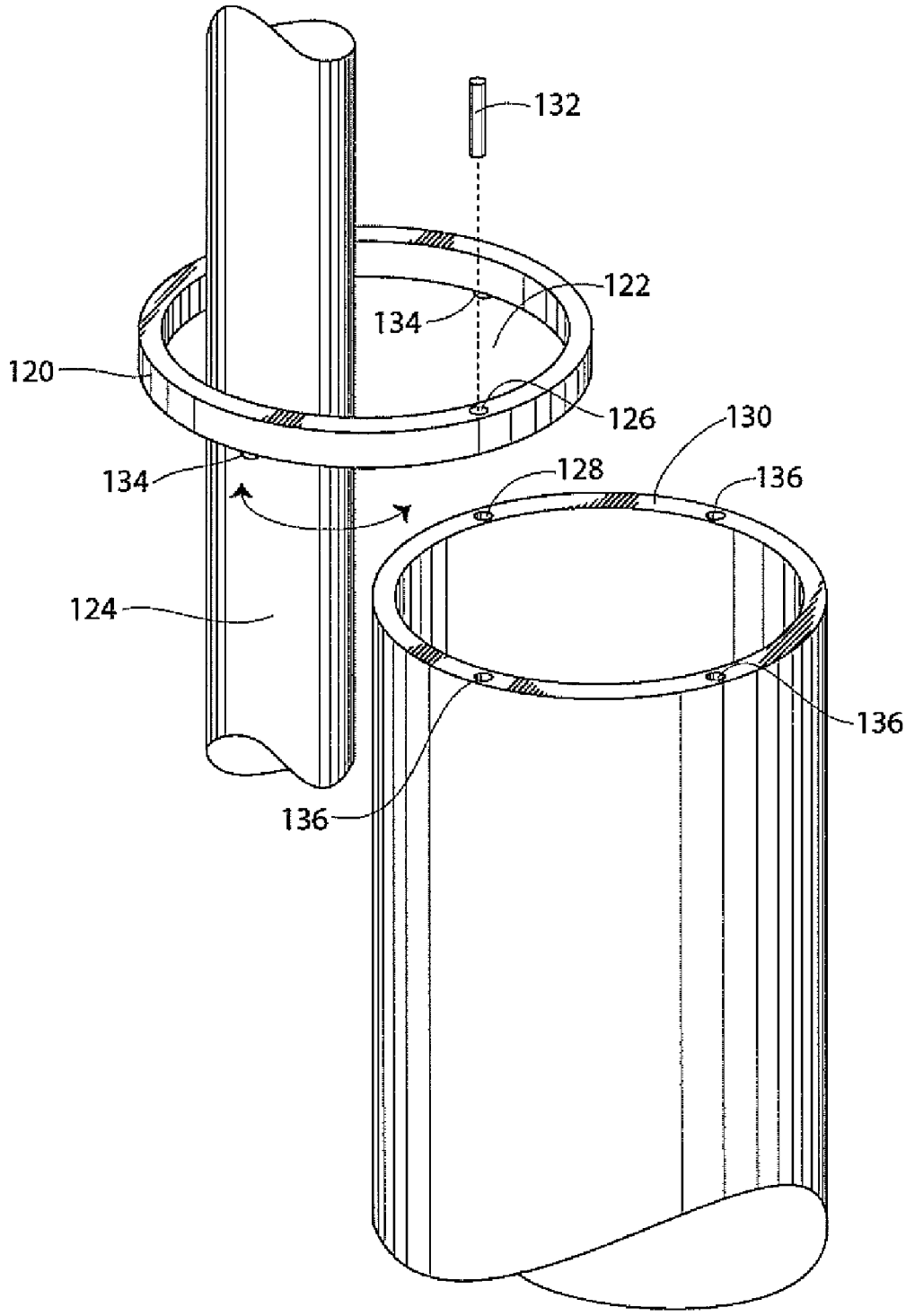
FIG. 9 illustrates in exploded perspective view an alternate embodiment of the container for golf balls having a selectively positionable cap for holding a shaft of a golf club.

FIG. 9 illustrates in exploded perspective view an alternate embodiment of the container for golf balls having a selectively positionable cap 120 that defines an aperture 122 for holding a shaft 124 of a golf club. The cap 120 defines a through hole 126 that aligns with a hole 128 in the container sidewall 130. A pin 132 extends through the hole 126 and into the hole 128. The cap 120 pivots about the pin 132, so the that the cap can be selectively positioned outwardly of the container for holding the golf club for use, or positioned inwardly co-axial with the container. Detents 134 projecting from the cap 120 engage recesses 136 to hold the cap 120 aligned with the container.

While this invention has been described in detail with particular references to illustrated embodiments thereof, it should be understood that many modifications, additions and deletions, in additions to those expressly recited, may be made thereto without departure from the spirit and scope of the invention.

What is claimed is:

1. A container for sequential dispensing of golf balls, comprising:

a housing having an interior cavity for receiving at least one golf ball;

a pair of opposing legs extending from the housing and defining an opening;

a projecting stop extending inwardly from at least one of the legs for holding the golf ball between the legs and selectively movable from a first position for holding the golf ball between the legs and a second position outwardly for releasing the golf ball for passage through the opening between the legs, whereby the projecting stop being moved from the first position to the second position enables the golf ball to pass by the projecting stop and through the opening for removal from the container; and a cap defining an aperture and pivotably attached to an upper edge of the container to be movable from a first position coextensive with the upper edge and a second position lateral of the container, for selective receiving a shaft of a golf club therethrough.

2. The container as recited in claim 1, wherein the legs are flexibly movable between a first position for holding the gold ball between the legs stopped by the projecting stop and a second position outwardly relative to each other for removal of the golf ball.

3. The container as recited in claim 1, wherein the projecting stop comprises a pair of resilient pads each projecting from an interior surface of a respective leg.

4. The container as recited in claim 1, wherein the projecting stop comprises a lug projecting from an interior surface of one of the legs towards the opposing leg.

5. The container as recited in claim 4, wherein the lug comprises a distal end of a threaded member extending through the leg inwardly and secured to the leg.

6. The container as recited in claim 4, wherein the lug comprises a projecting integral portion of the leg.

7. The container as recited in claim 1, wherein the projecting stop comprises a pin extending through one of the legs and movable laterally of the leg between the first and second positions.

8. The container as recited in claim 7, wherein the pin is biased by a spring to the first position.

9. The container as recited in claim 1, further comprising a pin extending though the cap and the container to define a pivot on which the cap turns to move between the first and the second positions.

10. The container as recited in claim 1, wherein the housing comprises an elongated cylinder for which the interior cavity has a diameter closely sized to a diameter of PGA-dimensioned golf ball to be received within the interior cavity.

11. The container as recited in claim 10, wherein the legs define arcuate surfaces extending coaxially with the cylinder with opposing side edges that define a gap with the respective side edge of the opposing leg, for gripping the golf ball held between the legs for removal therefrom.

12. The container as recited in claim 1, further comprising an attacher for attaching the housing to a golf bag.

13. The container as recited in claim 7, wherein attacher comprises a clip for slidingly engagement with an edge of a golf ball bag for holding the container thereto.

14. The container as recited in claim 1, further comprising a patch attached to the housing and having a surface of a first character for selective and detachable engagement to a patch on a golf accessory having a surface of a second character matingly engagable with the patch on the housing.

15. The container as recited in claim 1, wherein the housing defines a window in a surface thereof, whereby the number of golf balls within the interior cavity are observable.

16. The container as recited in claim 1, wherein opposing surfaces of the housing and the cap define matable detents and recesses for securing the cap in the first position.

17. A container for sequential dispensing of golf balls, comprising:

an elongated housing having an interior cylindrical cavity for receiving a plurality of golf balls;

a pair of opposing legs extending co-axial with the cavity and defining an opening at an end of the cavity and the legs having opposing edges to define opposing gaps for grasping a surface of a golf ball held between the legs;

a projecting stop extending inwardly of the cavity for restricting passage of a golf ball from the opening, the projecting stop having a first position for holding the golf ball between the legs and a second position for passage of the golf ball through the opening, whereby the projecting stop being moved from the first position to the second position enables the golf ball to pass by the projecting stop and through the opening for removal from the container; and a cap defining an aperture and pivotably attached to an upper edge of the container to be movable from a first position coextensive with the upper edge and a second position lateral of the container, for selective receiving a shaft of a golf club therethrough.

18. The container as recited in claim 17, wherein the legs are flexibly movable between a first position for holding the gold ball between the legs stopped by the projecting stop and a second position outwardly relative to each other for removal of the golf ball.

19. The container as recited in claim 17, wherein the projecting stop comprises a pair of resilient pads each projecting from an interior surface of a respective leg.

20. The container as recited in claim 17, wherein the projecting stop comprises a lug projecting from an interior surface of one of the legs towards the opposing leg.

21. The container as recited in claim 20, wherein the lug comprises a distal end of a threaded member extending trough the leg inwardly and secured to the leg.

22. The container as recited in claim 20, wherein the lug comprises a projecting integral portion of the leg.

23. The container as recited in claim 17, wherein the projecting stop comprises a pin extending trough one of the legs and movable laterally of the leg between the first and second positions.

24. The container as recited in claim 23, wherein the pin is biased by a spring to the first position.

25. The container as recited in claim 17, further comprising a pin extending through the cap and the container to define a pivot on which the cap turns to mow between the first and the second positions.

26. The container as recited in claim 17, wherein the housing defines a window in a surface thereof, whereby the number of golf balls within the interior cavity are observable.

27. The container as recited in claim 17, further comprising an attacher for attaching the housing to a golf bag.

28. The container as recited in claim 17, wherein opposing surfaces of the housing and the cap define matable detents and recesses for securing the cap in the first position.

29. A container for sequential dispensing of golf balls, comprising:

a housing having an interior cavity for receiving at least one golf ball;

a pair of opposing legs extending from the housing and defining an opening;

a projecting stop extending inwardly from at least one of the legs for holding the golf ball between the legs and selectively movable from a first position for holding the golf ball between the legs and a second position outwardly for releasing the golf ball for passage through the opening between the legs, the projecting stop comprising a distal end of a threaded member extending through the leg inwardly and secured to the leg and projecting from an interior surface of one of the legs towards the opposing leg, whereby the projecting stop being moved from the first position to the second position enables the golf ball to pass by the projecting stop and through the opening for removal from the container.

30. The container as recited in claim 29, wherein the legs are flexibly movable between a first position for holding the gold ball between the legs stopped by the projecting stop and a second position outwardly relative to each other for removal of the golf ball.

31. The container as recited in claim 29, wherein the projecting stop further comprises a pair of resilient pads each projecting from an interior surface of a respective leg.

32. The container as recited in claim 29, wherein the threaded member defines a lug projecting from an interior surface of one of the legs towards the opposing leg.

33. The container as recited in claim 29, wherein the threaded member is movable laterally of the leg between the first and second positions.

34. The container as recited in claim 29, further comprising a cap defining an aperture and pivotably attached to an upper edge of the container to be movable from a first position coextensive with the upper edge and a second position lateral of the container, for selective receiving a shaft of a golf club therethrough,

35. The container as recited in claim 34, further comprising a pin extending through the cap and the container to define a pivot on which the cap turns to move between the first and the second positions.

36. The container as recited in claim 34, wherein opposing surfaces of the housing and the cap define matable detents and recesses for securing the cap in the first position.

37. The container as recited in claim 29, wherein the legs define arcuate surfaces extending coaxially with the cylinder with opposing side edges that define a gap with the respective side edge of the opposing leg, for gripping the golf ball held between the legs for removal therefrom.

38. The container as recited in claim 29, wherein the housing defines a window in a surface thereof, whereby the number of golf balls within the interior cavity are observable.

39. The container as recited in claim 29, further comprising an attacher for attaching the housing to a golf bag.

40. The container as recited in claim 39, wherein attacher comprises a clip for slidingly engagement with an edge of a golf ball bag for holding the container thereto.

41. The container as recited in claim 29, further comprising a patch attached to the housing and having a surface of a first character for selective and detachable engagement to a patch on a golf accessory having a surface of a second character matingly engagable with the patch on the housing.

42. A container for sequential dispensing of golf balls, comprising:

an elongated housing having an interior cylindrical cavity for receiving a plurality of golf balls and having a diameter sized to receive the golf balls in single-file relationship;

a pair of opposing legs extending co-axial with the cavity and defining an opening at an end of the cavity and the legs having opposing edges to define opposing gaps for grasping a surface of a golf ball held between the legs; and a projecting stop extending inwardly of the cavity for restricting passage of a golf ball from the opening, the projecting stop having a first position for holding the golf ball between the legs and a second position for passage of the golf ball through the opening, the projecting stop comprising a distal end of a threaded member extending through the leg inwardly and secured to the leg and projecting from an interior surface of one of the legs towards the opposing leg, whereby the projecting stop being moved from the first position to the second position enables the golf ball to pass by the projecting stop and through the opening for removal from the container.

43. A container for sequential dispensing of golf balls, comprising:

a housing having an interior cavity for receiving at least one golf ball;

a pair of opposing legs extending from the housing and defining an opening;

a projecting stop extending inwardly from at least one of the legs for holding the golf ball between the legs and selectively movable from a first position for holding the golf ball between the legs and a second position outwardly for releasing the golf ball for passage through the opening between the legs, whereby the projecting stop being moved from the first position to the second position enables the golf ball to pass by the projecting stop and through the opening for removal from the container; and a cap defining an aperture and pivotably attached to an upper portion of the container to be movable from a first position coaxial with the interior cavity and a second position lateral of the container, for selective receiving a shaft of a golf club therethrough.

44. The container as recited in claim 43, wherein opposing surfaces of the housing and the cap define matable detents and recesses for securing the cap in the first position.

* * * * *